United States Patent [19]

Friend et al.

[11] 4,213,829

[45] Jul. 22, 1980

[54] RETRACTABLE HOOD FOR TRANSFER OF COKE

[75] Inventors: Donald L. Friend, Olympia Fields, Ill.; John A. Grosko, West Mifflin Boro; Richard B. Liniger, II, Cranberry Township, Butler County, both of Pa.

[73] Assignee: United States Steel Corporation, Pittsburgh, Pa.

[21] Appl. No.: 45,530

[22] Filed: Jun. 4, 1979

[51] Int. Cl.[2] ..... C01B 27/04; B65G 11/00

[52] U.S. Cl. ..... 202/263; 202/262; 202/227; 193/17

[58] Field of Search ..... 202/227, 228, 262, 263; 201/39; 193/17, 18, 35 TE, 3

[56] References Cited

U.S. PATENT DOCUMENTS

| | | | |
|---|---|---|---|
| 2,219,226 | 10/1940 | Gerber | 17/193 |
| 3,984,289 | 10/1976 | Sustarsic et al. | 202/262 |
| 4,053,068 | 10/1977 | Gidick | 202/262 |
| 4,083,753 | 4/1978 | Rogers et al. | 202/263 |
| 4,113,572 | 9/1978 | Manda et al. | 202/262 |

FOREIGN PATENT DOCUMENTS

| | | | |
|---|---|---|---|
| 1310980 | 3/1973 | United Kingdom | 202/263 |

*Primary Examiner*—Joseph Scovronek
*Assistant Examiner*—Chris Konkol
*Attorney, Agent, or Firm*—William F. Riesmeyer

[57] ABSTRACT

This invention relates to an improved hood for transfer of coke which prevents binding of the retractable section when it is raised or lowered. The outer surface of the fixed hood section is of circular arc-shape and has at least one track extending therealong. A wheel assembly on the retractable section engages the track so as to guide the retractable section concentrically over the fixed section and prevent binding. Preferably the wheel assembly is outboard of the upper edge of the retractable section. A device is then provided to exert force on the wheel assembly toward the track so as to retain contact between the wheel and track as the retractable section is raised.

6 Claims, 5 Drawing Figures

RETRACTABLE HOOD FOR TRANSFER OF COKE

BACKGROUND OF THE INVENTION

This invention relates to a hood for preventing escape of pollutants to the atmosphere when transferring coke therethrough, and particularly to a hood having a retractable extension at its lower end for engaging a container in which the coke is to be received.

In the past, coke has been pushed from the oven through an open guide car into a quench car. Of course, this procedure causes considerable emission of particulates during the pushing operation. More recently, various methods have been tested and used in an attempt to collect the particulate-containing gases and then clean them to remove the particulates. All of these systems require that the gas be contained and collected during the pushing operation. One such containment apparatus is a hood mounted directly on the travelling guide car. The hood may have a retractable section which can be raised to allow positioning of a quench car adjacent the guide and lowered for engaging the quench car during pushing of the coke from the oven. Because of the heat involved, the hood generally is of very heavy construction in order to prevent warping. Thus, heavy apparatus is required for raising or lowering the retractable section. Even when the hood is of heavy construction tendency toward warping remains causing binding of the retractable section against the fixed section. When binding occurs, it is necessary to push the coke without collecting the gases, allowing them to escape to the atmosphere.

It is therefore the primary object of this invention to provide a hood for transferring coke, which is of relatively light construction, and has a retractable section which will not bind during the raising or lowering thereof.

SUMMARY OF THE INVENTION

A hood with a retractable section provided for transfer of coke to a container. The hood has a fixed section extending laterally and downward in a general arc-shape toward the container. The retractable section is pivotally attached to the fixed section adjacent its lower end along the inner surface of the arc and is movable concentrically over at least a lower portion of the fixed section. Means is provided for alternately raising and lowering the retractable section, to allow travel of the container for placement beneath the fixed section when raised, and engagement with the container when coke is being transferred.

In the improvement of this invention, the outer surface of the fixed section has a circular-arc shape in the longitudinal direction. The circular arc-shape portion extends from the lower end of the fixed section upward at least to a height correspnding to the extreme uppermost position to which the retractable section is to be raised. At least one track extends longitudinally along the circular arc-shape portion of the outer surface of the fixed section. A wheel assembly mounted on the retractable section engages the track so as to guide the retractable section during the raising and lowering thereof in order to prevent binding with the fixed section.

BRIEF DESCRIPTION OF THE DRAWINGS

Other objects and advantages of the invention will be more apparent from the following detailed description when taken in conjunction with the appended claims and drawings, in which:

DESCRIPTION OF THE PREFERRED EMBODIMENT

Figure 1:
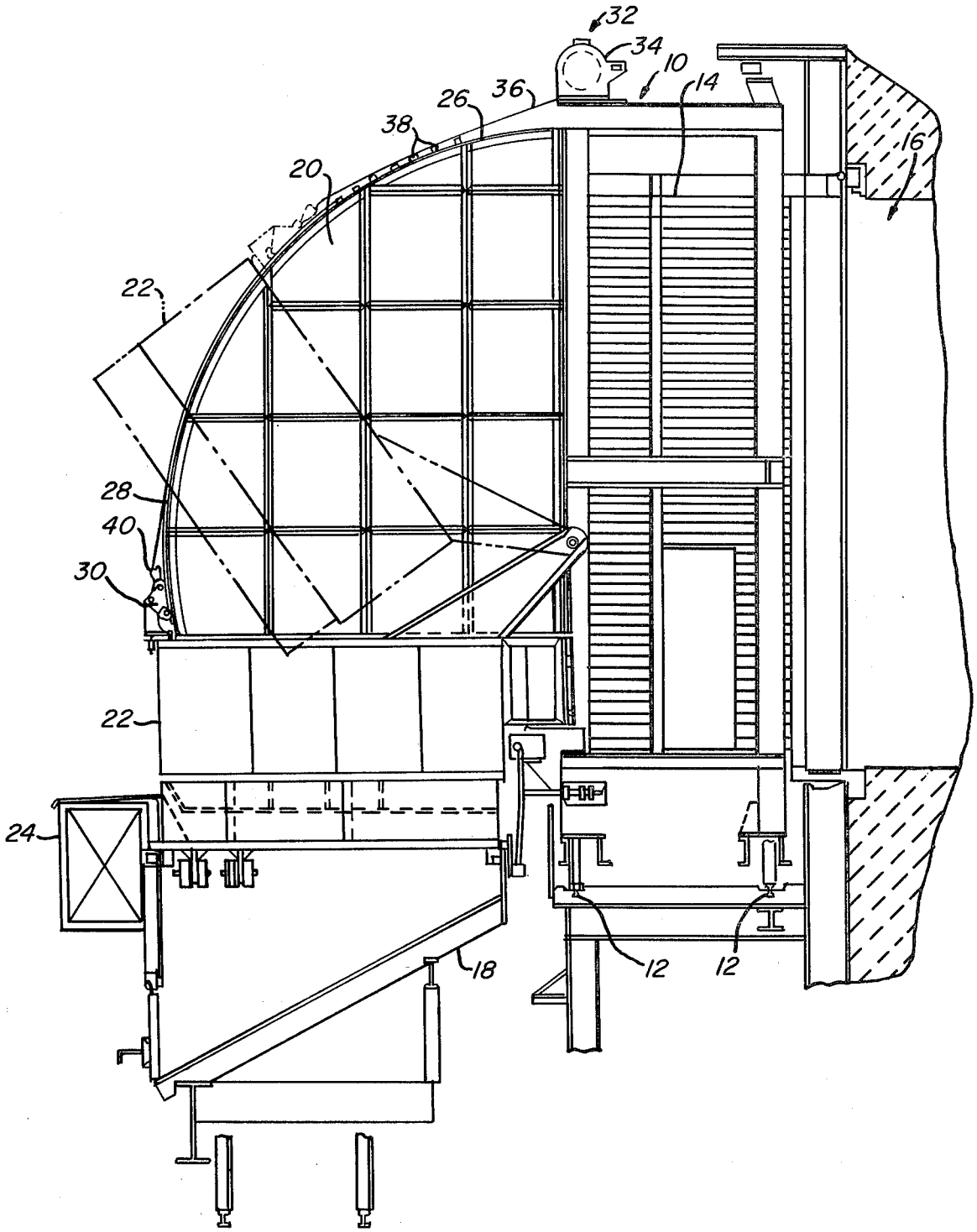
FIG. 1 is a side elevation of the apparatus of this invention.
Figure 2:
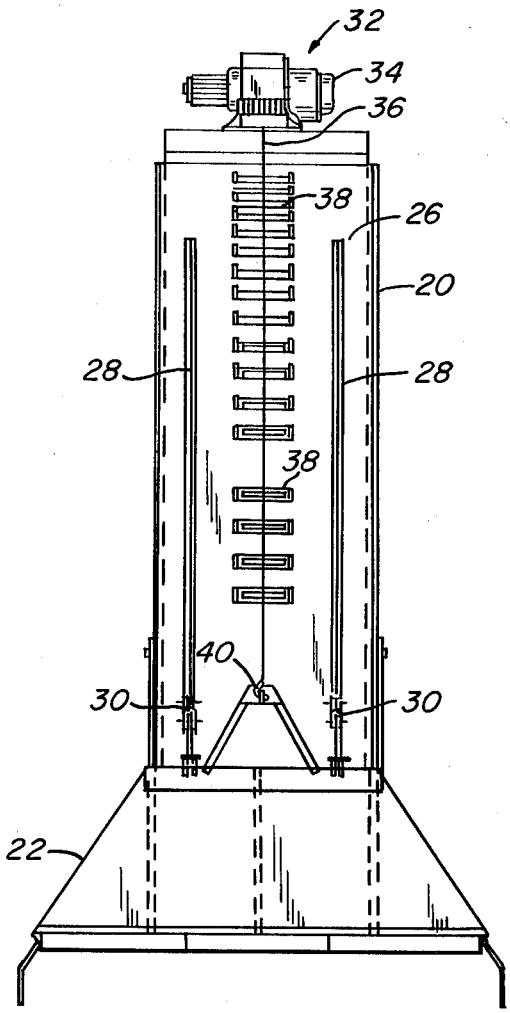
FIG. 2 is a front elevation view in the direction II—II of FIG. 1.

As shown in FIGS. 1 and 2 coke guide car 10 travels on tracks 12 for positioning adjacent coke oven 16. Guide cage 14 is laterally movable for engaging the door jamb of oven 16. Coke is pushed through cage 14 in conventional fashion into quench car 18. Guide car 10 has a fixed hood section 20 and a retractable hood section 22 for containing gases and particulates emitted from the coke. The gases are collected through duct 24 and conveyed to a gas cleaning car (not shown).

According to this invention, the outer surface 26 of fixed section 20 is of circular arc-shape and has a pair of spaced tracks 28 extending longitudinally therealong. The tracks may be made of steel angle irons as shown. Retractable section 22 is pivotally attached to fixed section 20 at the axis of the arc of outer surface 26 and has a pair of wheel assemblies 30 riding on tracks 28. Means is provided for raising and lowering retractable section 22 and includes cable reel assembly 32 driven by reversible motor 34, and cable 36. Cable 36 extends along outer surface 26 of fixed section 20 on guide means 38 which as shown is a plurality of spaced frictionless rollers. Cable 36 is attached to retractable section 22 by hook 40.

Figure 3:
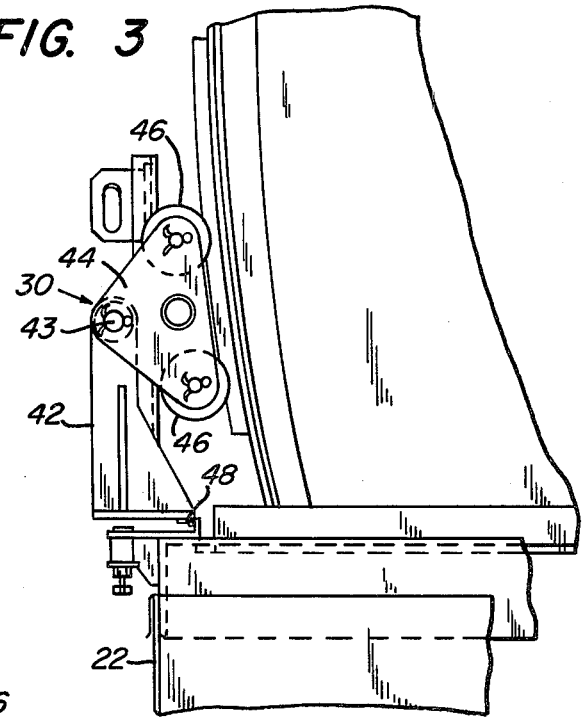
FIG. 3 is an enlarged view taken at III—III of FIG. 2.
Figure 4:
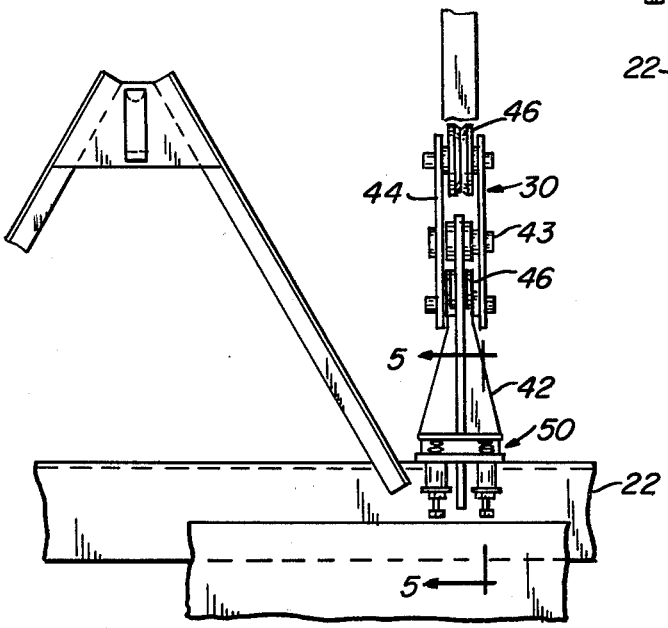
FIG. 4 is a partial front elevation view taken at IV—IV of FIG. 3.
Figure 5:
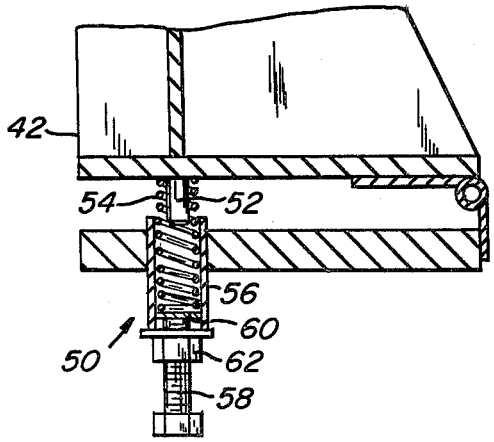
FIG. 5 is an enlarged sectional view taken at V—V of FIG. 4.

As shown in FIGS. 3, 4 and 5 wheel assembly 30 extends upward and outward from the upper edge of retractable section 22. Bracket 42 is pivotally attached by pin 43 to track 44 of the wheel assembly at a location intermediate the pair of wheels 46 thereof. Bracket 42 is pivotally attached to retractable section 22 by pin 48. Means is provided for retaining wheels 46 on the track as the retractable section is raised, and includes spring assemblies 50 which exert force on bracket 42. Spring assemblies 50 include pin 52 secured to bracket 42 which serves as a guide for spring 54 along with housing 56 secured to retractable section 22. Means is provided for adjusting spring assembly 50 to regulate the force exerted on the retractable section, and includes bolt 58 engaging spring 54 at plate 60, and nut 62 for locking bolt 58 in place.

We claim:

1. In a hood for preventing escape of pollutants when transferring coke therethrough, said hood having a fixed section extending from an upper end to a lower end adjacent a container for receiving said coke, a retractable section pivotally attached to the lower end of said fixed section for movement concentrically over a portion thereof, and means for raising and lowering said retractable section, the improvement in said hood which comprises:

said fixed section having a circular arc-shaped portion extending longitudinally on the outer surface thereof remote from the pivot of said retractable section, said circular arc portion extending from the lower end of said fixed section upward at least to the height corresponding to the extreme upper position to which said retractable section is to be raised, at least one track extending longitudinally along the circular arc-shape portion of said fixed section, and a wheel assembly mounted on said retractable section and engaging said track so as to guide the retractable section during the raising and lowering thereof in order to prevent binding with the fixed section.

2. The apparatus of claim 1 wherein at least two tracks are spaced laterally apart on said fixed section, and a pair of wheel assemblies are mounted on said retractable section each riding on one of said tracks.

3. The apparatus of claim 1 wherein the means for raising and lowering the retractable section comprises a cable reel assembly mounted adjacent the upper end of said fixed section, said cable reel assembly having a cable extending therefrom along the outer arc-shape surface of said fixed section to said retractable section and attached thereto, means for guiding said cable along the outer arc-shape surface of said fixed section, and motor means for alternately drawing and withdrawing cable on said reel assembly.

4. The apparatus of claim 1 wherein said assembly is pivotally attached to the upper edge of said retractable section and extends upwardly therefrom toward the arc-shaped portion of said fixed section, and further comprising means for retaining said wheel assembly in engagement with said track while the retractable section is raised and lowered.

5. The apparatus of claim 4 wherein said wheel assembly comprises a pair of wheels riding on said track, and a truck in which said wheels are rotatably mounted.

6. The apparatus of claim 5 in which said wheel retaining means comprises a bracket pivotally attached at one end to the truck of said wheel assembly at a location intermediate the wheels thereof, said bracket being pivotally attached at the other end thereof to the upper edge of said retractable section, and a spring assembly mounted between said retractable section and said bracket for pushing upwardly on said bracket as the retractable section is raised and thus exerting a force on said wheel assembly toward said track.

* * * * *